US009284964B2

(12) United States Patent
Sites

(10) Patent No.: US 9,284,964 B2
(45) Date of Patent: Mar. 15, 2016

(54) PARALLEL DYNAMIC COMPRESSOR ARRANGEMENT AND METHODS RELATED THERETO

(75) Inventor: Omar Angus Sites, Spring, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 517 days.

(21) Appl. No.: 13/643,539

(22) PCT Filed: May 2, 2011

(86) PCT No.: PCT/US2011/034768

§ 371 (c)(1), (2), (4) Date: Oct. 25, 2012

(87) PCT Pub. No.: WO2011/146231

PCT Pub. Date: Nov. 24, 2011

(65) Prior Publication Data

US 2013/0058800 A1 Mar. 7, 2013

Related U.S. Application Data

(60) Provisional application No. 61/347,221, filed on May 21, 2010, provisional application No. 61/474,585, filed on Apr. 12, 2011.

(51) Int. Cl.

| | |
|---|---|
| ***F04B 25/00*** | (2006.01) |
| ***F04B 41/06*** | (2006.01) |
| ***F04D 25/16*** | (2006.01) |

(Continued)

(52) U.S. Cl.

CPC ..... *F04D 25/16* (2013.01); *F04D 25/04* (2013.01); *F04D 25/06* (2013.01); *F04B 25/00* (2013.01); *F04B 41/06* (2013.01)

(58) Field of Classification Search

CPC ..... F04B 25/00; F04B 41/06
USPC ..... 417/244, 247, 248, 250, 266
See application file for complete search history.

(56) References Cited

U.S. PATENT DOCUMENTS

| | | | |
|---|---|---|---|
| 2,194,054 | A | 3/1940 | Peterson |
| 2,301,645 | A | 11/1942 | Sinclair |

(Continued)

FOREIGN PATENT DOCUMENTS

| | | |
|---|---|---|
| DE | 800359 | 7/1949 |
| DE | 913945 | 6/1954 |

(Continued)

OTHER PUBLICATIONS

Kleiner, S. et al. (2003) "Increase Power and Efficiency of LNG Refrigeration Compressor Drivers," *Hydrocarbon Processing*, pp. 67-69.

(Continued)

*Primary Examiner* — Peter J Bertheaud
(74) *Attorney, Agent, or Firm* — ExxonMobil Upstream Research Company Law Department

(57) ABSTRACT

This disclosure is directed to a novel arrangement for equipment used to compress fluids. A single prime mover is connected to a plurality of compressors. A supply conduit with parallel branch conduits directs fluid to be compressed to at least two compressors and parallel output conduits from each compressor are connected to a common output conduit, which directs compressed fluids to at least one additional compressor.

8 Claims, 7 Drawing Sheets

(51) Int. Cl.
*F04D 25/04* (2006.01)
*F04D 25/06* (2006.01)

(56) References Cited

U.S. PATENT DOCUMENTS

| | | | | |
|---|---|---|---|---|
| 2,377,851 | A | 6/1945 | Blank | |
| 2,547,660 | A | 4/1951 | Prince | |
| 3,043,162 | A | 7/1962 | Kugel | |
| 3,677,033 | A | 7/1972 | Kneeland | |
| 3,724,226 | A | 4/1973 | Pachaly | |
| 3,735,600 | A | 5/1973 | Dowdell et al. | |
| 3,764,815 | A | 10/1973 | Habock et al. | |
| 3,780,534 | A | 12/1973 | Lofredo et al. | |
| 3,886,729 | A | 6/1975 | Amann et al. | |
| 3,888,082 | A | 6/1975 | Haide | |
| 3,919,837 | A | 11/1975 | Pradt | |
| 3,955,365 | A | 5/1976 | Arao | |
| 4,073,139 | A | 2/1978 | Armasow et al. | |
| 4,077,743 | A | 3/1978 | Cochrane et al. | |
| 4,077,748 | A | 3/1978 | Potz | |
| 4,082,011 | A | 4/1978 | McQuinn et al. | |
| 4,117,343 | A | 9/1978 | Hoffeins | |
| 4,119,861 | A | 10/1978 | Gocho | |
| 4,220,057 | A | 9/1980 | Kronogard | |
| 4,359,871 | A | 11/1982 | Strass | |
| 4,389,842 | A | 6/1983 | Behnert | |
| 4,404,812 | A | 9/1983 | Zinsmeyer | |
| 4,434,613 | A | 3/1984 | Stahl | |
| 4,463,556 | A | 8/1984 | Polzer et al. | |
| 4,503,666 | A | 3/1985 | Christoff | |
| 4,566,885 | A | 1/1986 | Haak | |
| 4,686,822 | A | 8/1987 | Frutschi | |
| 4,726,255 | A | 2/1988 | Humpfer et al. | |
| 4,848,084 | A | 7/1989 | Wirtz | |
| 4,951,467 | A | 8/1990 | Walsh et al. | |
| 4,964,843 | A | 10/1990 | Wahl | |
| 5,123,239 | A | 6/1992 | Rodgers | |
| 5,385,449 | A * | 1/1995 | Wenzel | 417/243 |
| 5,491,969 | A | 2/1996 | Cohn et al. | |
| 5,689,141 | A | 11/1997 | Kikkawa et al. | |
| 5,946,941 | A | 9/1999 | Sinelnikov | |
| 5,966,925 | A | 10/1999 | Torikai et al. | |
| 5,989,156 | A | 11/1999 | Matsubara et al. | |
| 6,068,452 | A | 5/2000 | Okada et al. | |
| 6,070,429 | A | 6/2000 | Low et al. | |
| 6,324,867 | B1 | 12/2001 | Fanning et al. | |
| 6,367,286 | B1 | 4/2002 | Price | |
| 6,393,867 | B1 | 5/2002 | Guillard | |
| 6,446,465 | B1 | 9/2002 | Dubar | |
| 6,463,740 | B1 | 10/2002 | Schmidt et al. | |
| 6,484,490 | B1 | 11/2002 | Olsen et al. | |
| 6,640,586 | B1 | 11/2003 | Baudat et al. | |
| 6,691,531 | B1 | 2/2004 | Martinez et al. | |
| 6,724,099 | B2 | 4/2004 | Klaar | |
| 6,732,529 | B2 | 5/2004 | Anderson | |
| 6,776,588 | B1 * | 8/2004 | Meyer et al. | 417/250 |
| 6,782,982 | B2 | 8/2004 | Wahl et al. | |
| 6,838,779 | B1 | 1/2005 | Kandil et al. | |
| 7,717,681 | B2 * | 5/2010 | Bohm et al. | 417/248 |
| 8,317,490 | B2 * | 11/2012 | Manning | 417/323 |
| 8,821,132 | B2 * | 9/2014 | Fejzuli | 417/266 |
| 2001/0004830 | A1 | 6/2001 | Wakana et al. | |
| 2002/0067042 | A1 | 6/2002 | Alvarez Ortega et al. | |
| 2002/0077512 | A1 | 6/2002 | Tendick et al. | |
| 2002/0114985 | A1 | 8/2002 | Shkolnik et al. | |
| 2002/0170312 | A1 | 11/2002 | Reijnen et al. | |
| 2003/0052485 | A1 | 3/2003 | Poteet et al. | |
| 2003/0074900 | A1 | 4/2003 | McFarland | |
| 2004/0107703 | A1 | 6/2004 | Gustafson | |
| 2006/0283206 | A1 | 12/2006 | Rasmussen et al. | |
| 2007/0060442 | A1 | 3/2007 | Ransbarger et al. | |
| 2009/0054191 | A1 | 2/2009 | Holt et al. | |

FOREIGN PATENT DOCUMENTS

| | | | |
|---|---|---|---|
| DE | 915022 | 7/1954 | |
| DE | 1903214 | 8/1970 | |
| DE | 10039813 | 2/2002 | |
| EP | 0529307 | 3/1993 | |
| EP | 0963035 | 12/1999 | |
| GB | 1208831 | 10/1970 | |
| SU | 718670 | 2/1980 | F25B 11/00 |
| WO | WO02-12692 | 2/2002 | |
| WO | WO2007-102964 | 9/2007 | |
| WO | WO2008-015224 | 2/2008 | |
| WO | WO2009-117787 | 10/2009 | |

OTHER PUBLICATIONS

Meissner Bolte & Partners, Civil Action No. 1347/05LH between Voith Turbo GmbH & Co. and Phillips Petroleum Company, 2005, 20 pages.

Roberts, M. H. et al. (2008) "Equipment and Machinery Advances Herald Next Generation of LNG Processes," *LNG Journal Online*, 11 pages.

PCT International Search Report and Written Opinion dated Jul. 27, 2011, 10 pgs.

* cited by examiner

PARALLEL DYNAMIC COMPRESSOR ARRANGEMENT AND METHODS RELATED THERETO

CROSS REFERENCE TO RELATED APPLICATIONS

This application is the National Stage of International Application No. PCT/US2011/034768, filed May 2, 2011, which claims priority from both U.S. patent application No. 61/347,221 filed on May 21, 2010, entitled PARALLEL DYNAMIC COMPRESSOR ARRANGEMENT and U.S. patent application No. 61/474,585 filed on Apr. 12, 2011 entitled PARALLEL DYNAMIC COMPRESSOR ARRANGEMENT AND METHODS RELATED THERETO, the entirety of which is incorporated by reference herein.

FIELD OF THE DISCLOSURE

Embodiments of the disclosure relate to apparatus and methods of compressing gas, such as natural gas. More particularly, embodiments of the disclosure relate to methods and apparatus for compressing gas using parallel compressor bodies coupled to a prime mover.

BACKGROUND OF THE DISCLOSURE

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Large volumes of natural gas (i.e. primarily methane) are located in remote areas of the world. This gas has significant value if it can be economically transported to market. Where the gas reserves are located in reasonable proximity to a market and the terrain between the two locations permits, the gas is typically produced and then transported to market through submerged and/or land-based pipelines. However, when gas is produced in locations where laying a pipeline is infeasible or economically prohibitive, other techniques must be used for getting this gas to market.

A commonly used technique for non-pipeline transport of gas involves liquefying the gas at or near the production site and then transporting the liquefied natural gas to market in specially-designed storage tanks aboard transport vessels. The natural gas is cooled and condensed to a liquid state to produce liquefied natural gas at substantially atmospheric pressure and at temperatures of about −162° C. (−260° F.) ("LNG"), thereby significantly increasing the amount of gas which can be stored in a particular storage tank. Once an LNG transport vessel reaches its destination, the LNG is typically off-loaded into other storage tanks from which the LNG can then be revaporized as needed and transported as a gas to end users through pipelines or the like.

Conventional plants used to liquefy natural gas are typically built in stages as the supply of feed gas, i.e. natural gas, and the quantity of gas contracted for sale, increase. Each stage normally consists of a separate, stand-alone unit, commonly called a train, which, in turn, is comprised of all of the individual components necessary to liquefy a stream of feed gas into LNG and send it on to storage. As the supply of feed gas to the plant exceeds the capacity of one stand-alone train, additional stand-alone trains are installed in the plant, as needed, to handle increasing LNG production.

In some cases, the economics of an LNG plant may be improved by driving the compressors in both a first and second compression strings through one or more common shafts. However, this does not overcome all of the disadvantages associated with each stand-alone train in an LNG plant requiring its own dedicated, compression strings. For example, a complete stand-alone train, including two or more compression strings, must be installed in a plant each time it becomes desirable to expand the LNG plant production capacity, which can add significantly to the capital and operating costs of the plant.

The rapid growth in natural gas demand has posed unique technical challenges for the LNG industry. There is a significant push towards designing and building larger capacity LNG trains. This need for larger trains requires new compressor driver and process configurations, while still reducing capital cost.

The foregoing discussion of need in the art is intended to be representative rather than exhaustive. A solution addressing one or more such needs, or some other related shortcomings in the technology would increase the efficiency and lower the cost of compressing fluids given the current state of the art.

SUMMARY OF THE DISCLOSURE

Provided are apparatus and methods of compressing gas, e.g., natural gas, which include one prime mover and three or more compressor bodies wherein the main drive shafts of all the compressor bodies are connected in series to the prime mover. Use of the apparatus increases efficiency and output capacity by compressing a fluid in two or more stages.

In one or more embodiments, at least two compressor body inlet conduits are connected in parallel, and the outlet conduits are also connected in parallel. Additional compressor body conduits would be connected in series. Optionally, a scrubber and cooler would be included between stages.

Using a higher powered prime mover rather than two smaller power units results in efficiency gain and requires less space. Compressor body pressure rating is also related to the inverse of the impeller diameter. Thus, the apparatus provides higher discharge pressures than a conventional design, since it will utilize multiple smaller diameter, therefore higher pressure, compressors instead of a single larger, potentially lower pressure compressor.

For the same capacity, the provided apparatus and methods enable the use of smaller compressors, which are easier to maintain and operate, and may be more reliable.

Some embodiments of this arrangement also allow one or more of the compressors to be decoupled from the driver used to provide process turndown or to allow maintenance.

BRIEF DESCRIPTION OF THE DRAWINGS

While the present disclosure is susceptible to various modifications and alternative forms, specific exemplary embodiments thereof have been shown in the drawings and are herein described in detail. It should be understood, however, that the description herein of specific exemplary embodiments is not intended to limit the disclosure to the particular forms disclosed herein, but on the contrary, this disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles.

Figure 1:
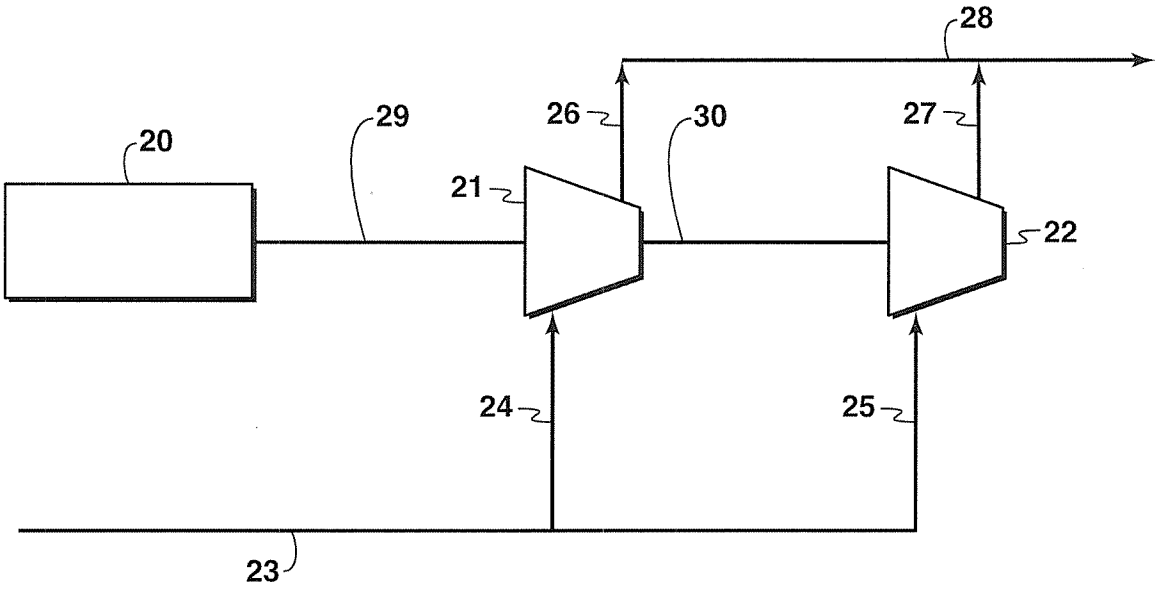
FIG. 1 Prior Art
FIG. 1 is a diagram of a known compressor arrangement incorporating two parallel compressors in a single string.

It should be noted that the figures are merely exemplary of several embodiments of the present invention and no limitations on the scope of the present invention are intended thereby. Further, the figures are generally not drawn to scale, but are drafted for purposes of convenience and clarity in illustrating various aspects of the invention.

DETAILED DESCRIPTION OF THE DISCLOSURE

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling with the scope of the appended claims.

The term "compressor" as used herein refers to a device used to increase the pressure of an incoming fluid by decreasing its volume. The compressors referenced herein specifically include the dynamic type (centrifugal, axial and mixed-flow) and exclude reciprocating compressors.

The term "compressor body" as used herein refers to a casing which holds the pressure side of the fluid passing through a compressor. The body is composed of the casing, shaft, impellers/blades and associated components. The compressor may have one or more inlets and outlets.

The term "compressor section" as used herein refers to a compressor body or portion of the compressor body associated with one gas outlet. Compressors with multiple gas outlets are multi-section compressors. As used herein, a single section will include at least one inlet, at least one impeller or row of blades and one outlet.

The term "sideload" as used herein refers to the higher pressure inlets of a compressor section that has more than one fluid inlet.

The term "compressor string" is used to describe the system of one or more compressor bodies mounted on a common shaft and driven by a common driver(s). The compressor string includes compressor body, drivers, gearboxes, starter motors, helper motors, generators, helper drivers, torque converters, fluid couplings, and clutches that are coupled to the same common shaft.

The term "driver" as used herein refers to a mechanical device such as a gas turbine, a steam turbine, an electric motor or a combination thereof which is used to cause rotation of a shaft upon which a compression string is mounted. A single compression string may have one or more drivers.

The term "prime mover" as used herein refers the driver that delivers the majority of the mechanical energy.

The term "stage" as used herein means the number of compressor bodies or compressor sections that the flow of the fluid being compressed will pass through in the string. Often the fluid is cooled between stages.

The term "interstage" as used herein means between the lower pressure and higher pressure stage. The scrubbers and coolers located between two compression stages are often called "interstage scrubbers" and "interstage coolers".

The term "starter/helper motor/generator" as used herein refers to a mechanical device such as a gas turbine, a steam turbine, an electric motor or a combination thereof which is used to rotate the prime mover to assist in starting the prime mover. Optionally, the device may be used to cause rotation of the compressor string to supplement the power provided by the prime mover. Optionally, the device may be used to absorb power from the prime mover to generate electricity. A variable frequency drive may be required to convert the electricity to a useful frequency.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

Gas compressors are used in various applications where an increase in pressure is needed: oil and gas production facilities, gas pipelines, gas processing plants, refineries, chemical plants, refrigeration, power plants, exhaust gas sequestration, etc. Gas compressors are also used in liquid natural gas (LNG) production facilities to compress the refrigerant(s) necessary to cool the natural gas sufficiently to convert it to a liquid stage.

A dynamic type (centrifugal or axial) compressor body is composed of the casing, shaft, impellers or blades, and associated components. Combinations of drivers and dynamic type compressors bodies that are coupled together by their rotating shafts are known as compressor strings. A typical compressor string in a facility may have a gas turbine or motor driver connected to one or more compressor body(s). A starter mechanism such as a starting motor may also be connected to the string. A gearbox or torque converter may be connected to the string to allow the driver(s) and compressor(s) to operate at a different speed(s). A helper motor or steam turbine may be added to the string to augment the power supplied by the driver. An electrical generator may be added to the string to generate power during periods when the compressor does not need all the power available from the driver. A single machine can serve as one or more of the following: electric starter, helper motor, and generator. A coupling may be used to connect shafts of two machines. A clutch, fluid coupling or torque converter may be used to engage or disengage power transmission from one shaft to another. Conventional centrifugal compressor strings use a single compressor body or multiple compressor bodies, piped in series and coupled to one or more drivers.

One parameter commonly used to characterize centrifugal compressors is flow coefficient. The flow coefficient describes the relationship of suction gas flow rate (capacity) to impeller diameter and impeller tip speed. The typical values for the flow coefficient are between 0.01 and 0.15. There are several variations of the flow coefficient formula, one version is:

$$\Phi=700q/(nD^3).$$

Where:

$\Phi$ is the flow coefficient;

q is impeller inlet actual flow rate in ACFM;

n is the impeller angular speed in rpm; and

D is the impeller diameter in inches.

The angular speed of the impeller is typically limited by the properties of the gas being compressed, especially the speed of sound in the gas medium. In this case, the tip speed of an impeller can be described by:

$$S=\pi nD,$$

where S is the impeller tip speed in inches/minute. By setting S to the maximum allowable speed ($S_{max}$) and combining the two equations, $$q_{max}=\Phi_{max}nD^3/700=\Phi n(S_{max}/\pi n)^3/700=\Phi_{max}(S_{max}/\pi)^3/(700n^2),$$

it follows that to attain the largest capacity ($q_{max}$), compressors would be designed with the maximum tip speed ($S_{max}$), maximum flow coefficient ($\Phi_{max}$) and the slower speeds n.

Conventional large compressor prime movers, e.g., for LNG plants, are gas turbines that operate near 3000 or 3600 rpm. Under such circumstances, the maximum capacity described:

$$q_{max}=0.15(S_{max}/\pi)^3/(700\cdot3000^2)=S_{max}/1.3\cdot10^{12}$$

Capacity may be increased by using more than one compressor string in parallel. For example, the capacity could be doubled by adding an identical compressor and prime mover in parallel with the first compressor and prime mover.

A conventional compressor arrangement of a compressor string is shown in FIG. 1. It consists of a prime mover 20 connected to compressors 21 and 22 via drive shafts 29 and 30. Inlets 24 and 25 for the compressors are connected in parallel as are the outlets 26 and 27.

Fluid to be compressed is supplied to the compressors via a conduit 23 and parallel input conduits 24 and 25. Compressed fluid leaves the compressors through parallel connected outlet conduits 26, 27 to a common outlet conduit 28.

Figure 2:
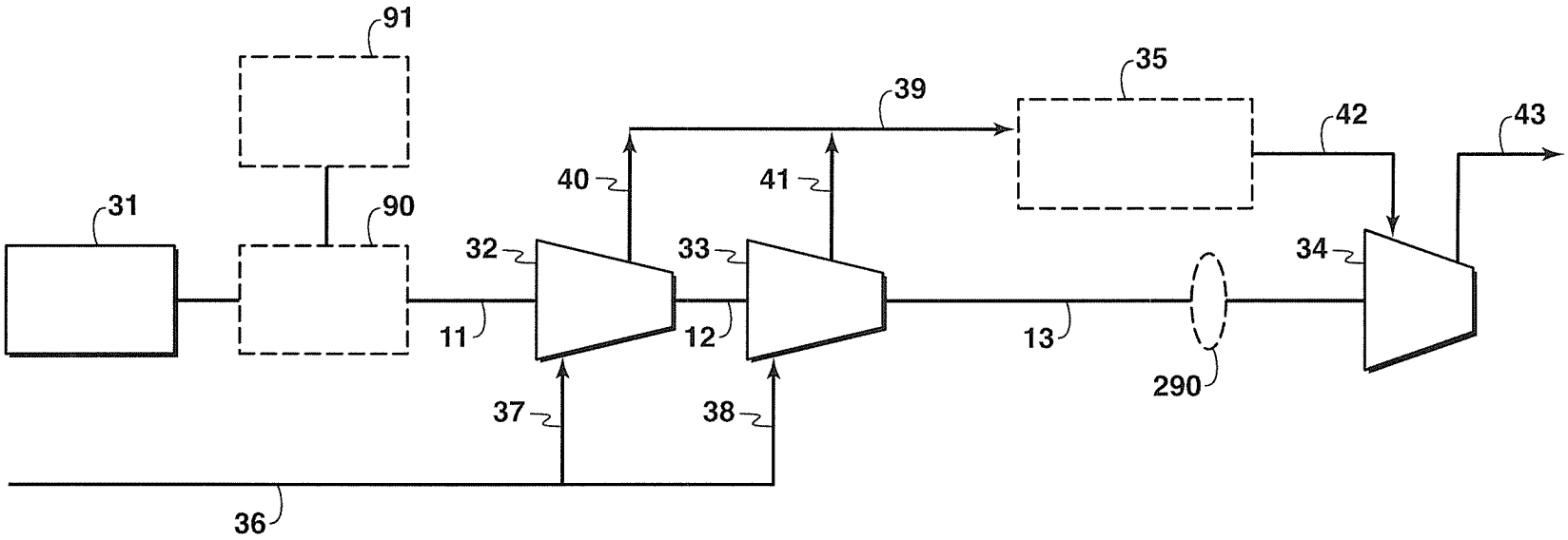
FIG. 2 is a diagram of a first implementation of a compressor string within the scope of the present disclosure.

Referring to FIG. 2, an exemplary compressor string according to the principles of the present disclosure is illustrated schematically. In the illustrated implementation, a single prime mover 31 is coupled to two low pressure compressors 32, 33 in series via drive shafts 11 and 12 and to a high pressure compressor 34 via drive shaft 13. The fluid to be compressed is supplied to the low pressure compressors via parallel branch conduits 37 and 38 from a supply conduit 36. Compressed fluid from the low pressure compressors leaves the compressors from output conduits 40, 41 to conduit 39, which may be connected to a cooling and scrubbing unit 35. The compressed fluid from the low pressure compressors is fed to high pressure compressor 34 by conduit 42 and exits compressor 34 via output conduit 43. A clutch 290 may be provided anywhere in the drive train and is shown as part of drive shaft 13 as an example.

A variable frequency driven starter/helper motor/generator 90 is optionally provided between the prime mover 31 and first compressor 32. A variable frequency drive mechanism may be provided at 91 for the starter/helper motor/generator 90. Here again, it should be understood that the illustration in FIG. 2 is representative only. The prime mover may be a steam turbine, gas turbine, natural gas internal combustion engine or an electric or hydraulic motor for example. The linkage between the prime mover and compressors may include one or more gearboxes, torque converters, clutches or fluid couplings. The compressors may be centrifugal compressors, axial compressors, rotary screw compressors, multiphase pumps, or centrifugal pumps for example.

While FIG. 2 illustrates a particular arrangement of the compressors, drivers, shafts, and conduits, it should be understood that the apparatus illustrated in FIG. 2 may be disposed relative to each other in a variety of configurations. For example, the high pressure compressor 34 may be located on the drive shaft 12 between the two low pressure compressors 32, 33 with the conduits 39, 40, and 41 being adjusted accordingly to direct the compressed gas from the low pressure compressors to the high pressure compressor 34. The present disclosure is directed to implementations where parallel input conduits provide a compressible fluid from a common conduit to an inlet for any two of the compressors on the string, and where outlet streams from the two compressors are withdrawn in parallel to provide a compressible fluid for one or more additional compressors on the string. FIG. 2 illustrates one such combination; other exemplary arrangements will be apparent and may be optimized based on equipment costs, operational costs, operational parameters, such as temperature and pressure, or any number of other factors.

Figure 3:
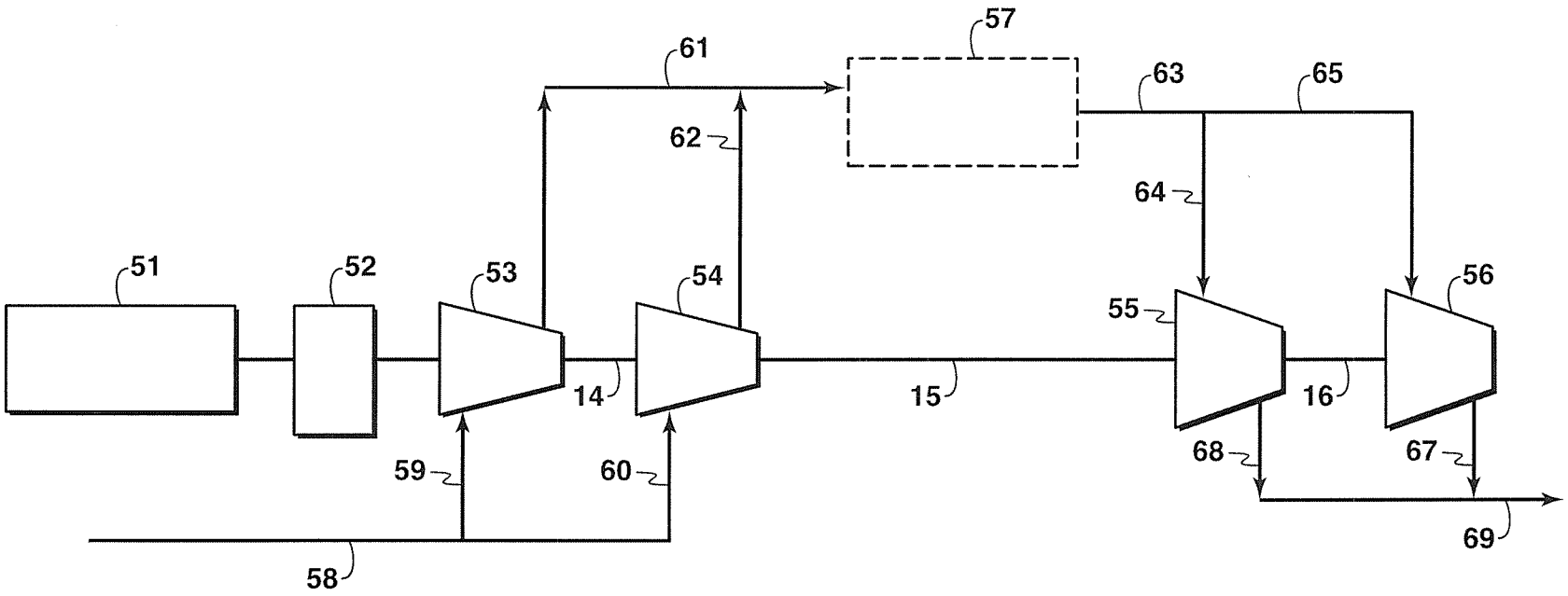
FIG. 3 is a diagram of a second embodiment of the compressor string.

FIG. 3 illustrates one exemplary further implementation of the improvements found in the present disclosure. In the implementation of FIG. 3 a gear box 52 is provided between the prime mover 51 and the first low pressure compressor 53. Also a second high pressure compressor 56 is coupled to the prime mover 51 via drive shafts 14, 15, 16. The compressed fluid flow from cooling and scrubbing unit 57 enters the high pressure compressors 55, 56 from parallel input conduits 64, 65 respectively. Output from the high pressure compressors is directed to an outlet conduit 69 via parallel conduits 68, 67. The schematic illustration of FIG. 3 may be adapted as described above in connection with FIG. 2.

Figure 4:
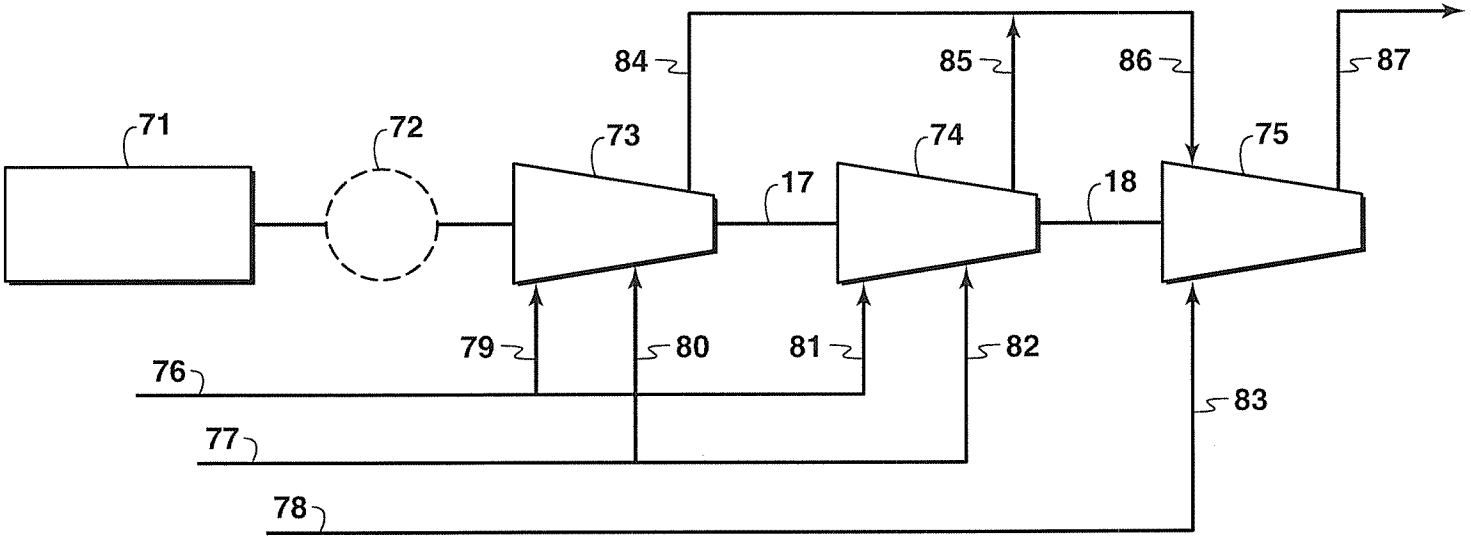
FIG. 4 is a diagram of a third embodiment of the compressor string.

A further embodiment of the invention is shown in FIG. 4. Prime mover 71 is coupled to two low pressure compressors 73, 74 and a high pressure compressor 75 via drive shafts 17 and 18. A starter/helper motor/generator 72 is optionally coupled to the drive train between the prime mover and first low pressure compressor 73. The outputs of the low pressure compressors are coupled via parallel output conduits 84, 85 to output conduit 86 which serves as an input to high pressure compressor 75. Each low pressure compressor has two side loads from supply conduits 76, 77. The high pressure compressor also has a side load 83 from supply conduit 78. Here again, this schematic representation of the compressor string illustrates the relevant components of the compressor string for discussion of the present inventions. Other components conventional in the industry may be incorporated according to conventional practice. For example, the auxiliary side loads providing inputs to the compressors may be provided in any conventional manner and may be associated with the compressors via conventional fluidic couplings. Further referring to FIG. 4, the high pressure compressor ("high") and low pressure compressors ("low") may be, while still be connected in parallel, utilized in different sequence, such as low-low-high, high-low-low, or low-high-low.

Figure 5:
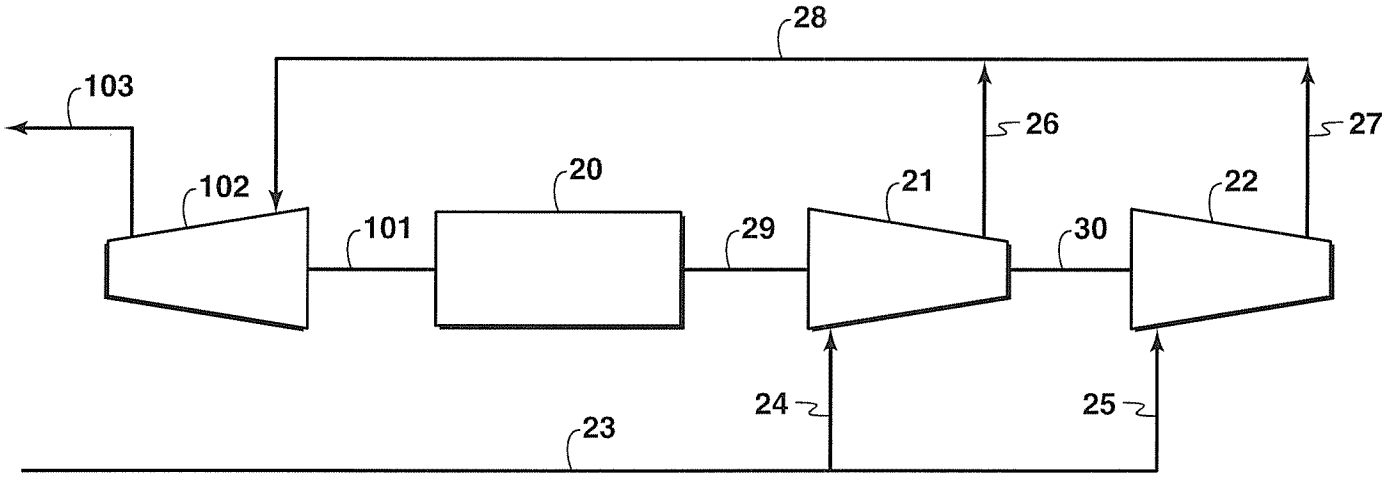
FIG. 5 is a diagram of a fourth embodiment of the compressor string.

FIG. 5 is a schematic illustration of a further implementation similar to FIG. 2 intended to show the diversity of implementations that may be developed consistent with the present inventions. In this implementation, prime mover 20 is provided with a second power output shaft 101 which is connected to a third, high pressure compressor 102 having an output conduit 103. The output conduits 26 and 27 from compressors 21, 22 are connected to output conduit 28 which in turn is connected to the input portion of compressor 102.

Figure 6:
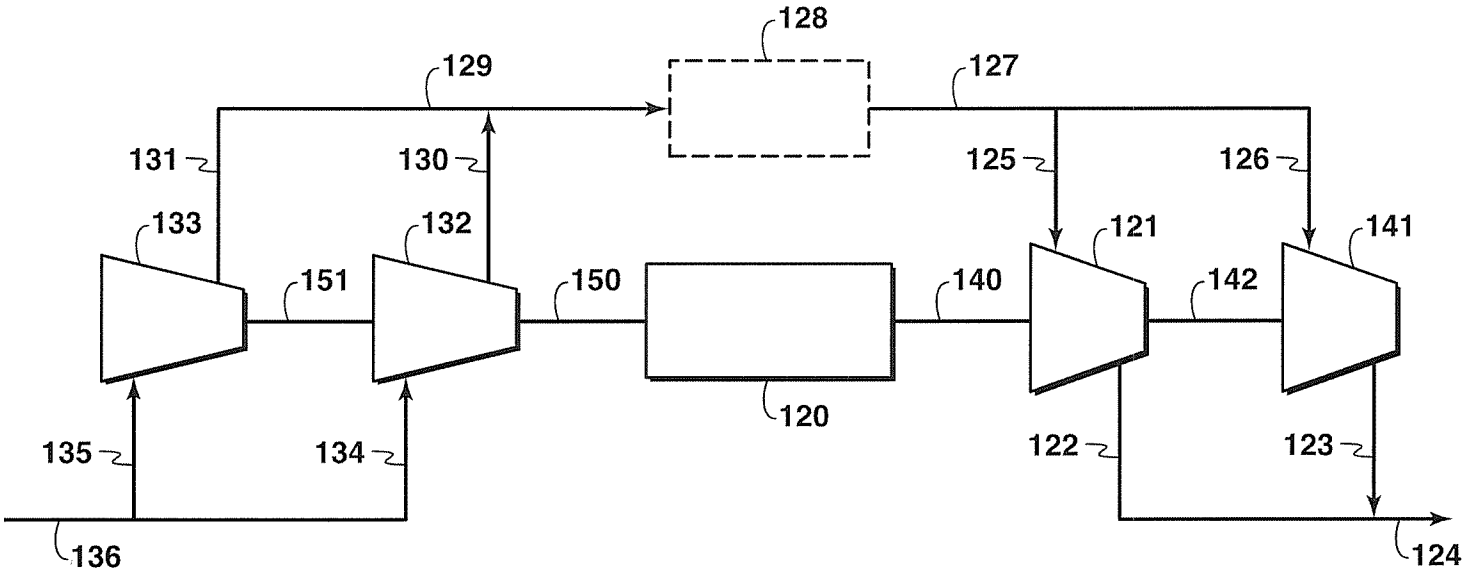
FIG. 6 is a diagram of a fifth embodiment of the compressor string.

FIG. 6 illustrates a still further implementation of compressor strings within the scope of the present disclosure. In this embodiment, a prime mover 120 has two power output shafts, 140, 150. A first output shaft 140 is connected to two high pressure compressors 121, 141. Power shaft 142 extends between first high pressure compressor 121 and second high pressure compressor 141. Compressed fluid from compressors 121, 141 leave via parallel output conduits 122, 123 to an output conduit 124. Prime mover 120 is also connected to two low pressure compressors 132, 133 via power shafts 150 and 151. Fluid to be compressed is supplied via inlet conduit 136 through two parallel conduits 135, 134 to low pressure compressors 133, 132. Output from the low pressure compressors is optionally directed via parallel output conduits 131, 130 through a cooling and scrubbing unit 128 and then to the high pressure compressors 121, 141 via conduit 127 and parallel input conduits 125, 126.

Figure 7:
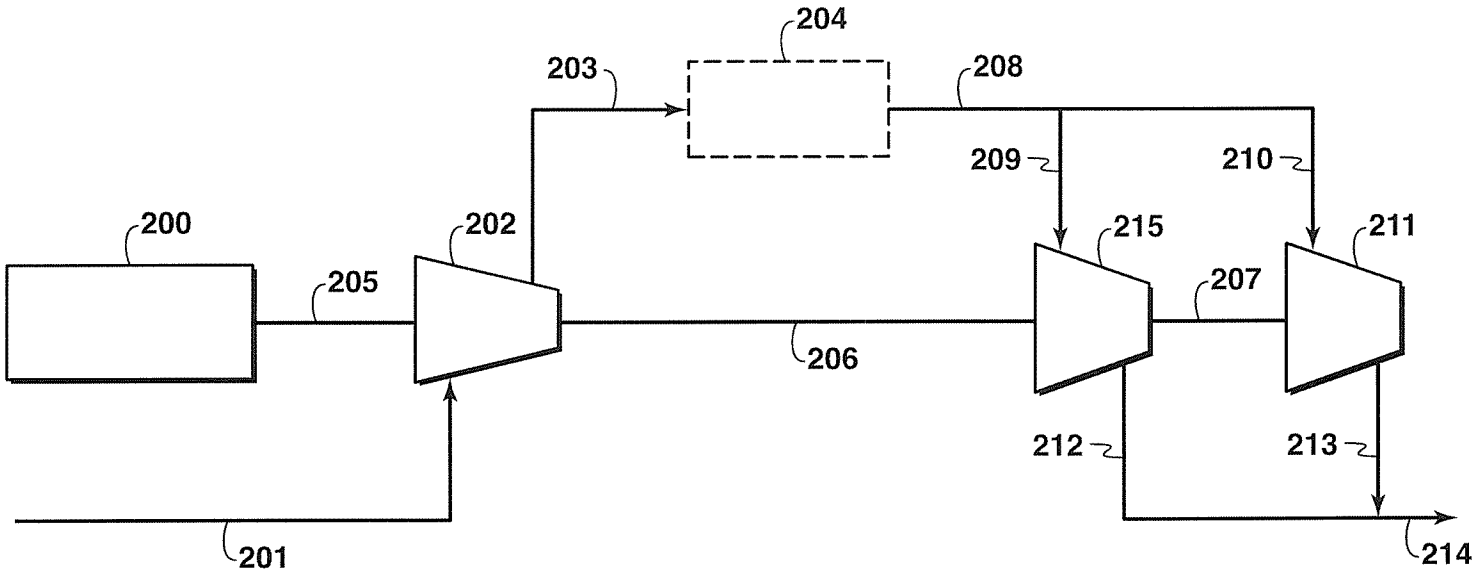
FIG. 7 is a diagram of a sixth embodiment of the compressor string.

In the embodiment of FIG. 7, prime mover 200 is connected via drive shaft 205 to a first low pressure compressor 202, and then to two high pressure compressors 215, 211 in series via drive shafts 206, 207. Fluid to be compressed enters low pressure compressor 202 via conduit 201. The output from low pressure compressor 202 flows through conduit 203 and optionally through cooling and scrubbing unit 204 from which it flows to high pressure compressors 215, 211 via conduit 208 and parallel input conduits 209, 210 respectively. Output from the high pressure compressors is directed to parallel output conduits 212, 213 to output conduit 214.

The foregoing embodiments are useful for many applications including oil and gas production facilities, gas pipelines, gas processing plants, refineries, chemical plants, refrigeration, power plants, exhaust gas sequestration, etc. The embodiments provided herein are particularly useful in large LNG plants, such as greater than about 1 million tons per annum (MTA), or greater than about 3 MTA, or greater than about 5 MTA, or greater than about 6 MTA, or greater than about 7 MTA, or greater than about 7.5 MTA or greater than about 9 MTA. The foregoing limits may be combined to form ranges, such as from about 3 to about 7.5 MTA.

While the present techniques of the invention may be susceptible to various modifications and alternative forms, the exemplary systems, methods, implementations, and embodiments discussed above have been shown by way of example. However, it should again be understood that the invention is not intended to be limited to the particular embodiments disclosed herein. Indeed, the present disclosure of the invention is to cover all modifications, equivalents, and alternatives falling within the spirit and scope of the invention as defined by the following appended claims.

In the present disclosure, several of the illustrative, non-exclusive examples of methods and systems have been discussed and/or presented in the context of flow diagrams, or flow charts, in which the methods and/or systems are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities, other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" may mean A alone, B alone, C alone, A and B together, A and C together, B and C together, A, B and C together, and optionally any of the above in combination with at least one other entity.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

I claim:

1. Apparatus for compressing fluids comprising:

a prime mover having at least one drive shaft mechanically coupled thereto;

a first compressor coupled to the prime mover via a first drive shaft;

a second compressor coupled to the prime mover via a second drive shaft;

a third compressor coupled to the prime mover via a third drive shaft;

a first conduit for connection to a source of fluid to be compressed;

a pair of parallel conduits each extending from the first conduit to respective inlets for any two of the three compressors;

a second conduit for connection to a source of fluid to be compressed, the second conduit having a pair of parallel conduits each extending to a respective side load inlet of any two of the three compressors; and a pair of parallel output conduits each extending from an outlet of the any two compressors, wherein the parallel output conduits convey compressed fluids; and wherein the compressed fluids are directed through one or more compressed fluid conduits to an inlet of the remaining compressor.

2. The apparatus of claim 1 wherein the any two compressors are low pressure compressors, and the remaining compressor is a high pressure compressor.

3. The apparatus of claim 2 further comprising cooling and scrubbing units connected between the output of the low pressure compressors and the input for the high pressure compressor.

4. The apparatus of claim 2 further comprising a fourth compressor coupled with the prime mover, and further comprising a pair of parallel output conduits connected to a respective outlet of the remaining compressor and the fourth compressor, wherein the one or more compressed fluid conduits comprises a pair of parallel input conduits fluidically coupled to inlets on the fourth compressor body and the remaining compressor.

5. The apparatus of claim 1 further including a gear box connected to one of the drive shafts.

6. The apparatus of claim 1 further comprising a starter/helper motor/generator connected to one of the drive shafts.

7. The apparatus of claim 6 further comprising a variable frequency drive connected to the starter/helper motor/generator.

8. The apparatus of claim 1 further comprising a third conduit for connection to a source of fluid to be compressed, the third conduit connected to an inlet of the remaining compressor.

* * * * *